US008444065B2

(12) United States Patent
Aihara et al.

(10) Patent No.: US 8,444,065 B2
(45) Date of Patent: May 21, 2013

(54) WATER DISCHARGE DEVICE

(75) Inventors: Yutaka Aihara, Fukuoka (JP); Minoru Sato, Fukuoka (JP); Minami Okamoto, Fukuoka (JP); Kiyotake Ukigai, Fukuoka (JP)

(73) Assignee: Toto Ltd. (JP)

( * ) Notice: Subject to any disclaimer, the term of this patent is extended or adjusted under 35 U.S.C. 154(b) by 234 days.

(21) Appl. No.: 13/119,883

(22) PCT Filed: Sep. 30, 2009

(86) PCT No.: PCT/JP2009/005043

§ 371 (c)(1),
(2), (4) Date: Mar. 18, 2011

(87) PCT Pub. No.: WO2010/038453

PCT Pub. Date: Apr. 8, 2010

(65) Prior Publication Data

US 2011/0168810 A1 Jul. 14, 2011

(30) Foreign Application Priority Data

Sep. 30, 2008 (JP) ..... 2008-252005

(51) Int. Cl.
*B05B 3/00* (2006.01)

(52) U.S. Cl.
USPC ..... 239/225.1; 239/227

(58) Field of Classification Search
USPC ..... 239/225.1, 227, 229, 230, 233, 236, 239/244, 255, 242
See application file for complete search history.

(56) References Cited

U.S. PATENT DOCUMENTS

| | | | | |
|---|---|---|---|---|
| 6,186,414 | B1 * | 2/2001 | Clearman et al. | 239/214 |
| 6,254,014 | B1 | 7/2001 | Clearman et al. | |
| 6,267,299 | B1 * | 7/2001 | Meyer | 239/222.17 |
| 6,422,480 | B1 * | 7/2002 | Richmond | 239/10 |
| 6,795,981 | B2 | 9/2004 | Sato et al. | |
| 7,252,246 | B2 * | 8/2007 | Heren et al. | 239/242 |
| 2004/0019962 | A1 | 2/2004 | Sato et al. | |
| 2010/0230512 | A1 | 9/2010 | Sato et al. | |

FOREIGN PATENT DOCUMENTS

| | | |
|---|---|---|
| EP | 1357235 | 10/2003 |
| JP | 61-263663 | 11/1986 |
| JP | S61-263663 A | 11/1986 |
| JP | 2003-304980 A | 10/2003 |

(Continued)

OTHER PUBLICATIONS

International Search Report; PCT/JP2009/005043; Nov. 24, 2009.

*Primary Examiner* — Davis Hwu
(74) *Attorney, Agent, or Firm* — Studebaker & Brackett PC; Donald R. Studebaker

(57) ABSTRACT

An object is to provide a water discharge device in which a water sprinkling member having water discharge ports can simultaneously achieve both good rotation start-up ability and good rotation stability. A water discharge device FC is configured in such a manner that the center of gravity of a rotor constituted of a tubular body 20 and a head 40 (the water sprinkling member) is positioned near an opening 4 which is located near the center of swing at which a central axis C1 of the tubular body 20 tilted by swinging revolution and a central axis C2 of an inflow chamber 3 intersect in a state where any water is not supplied to a buffer chamber 43 of the head 40, whereas the center of gravity of the rotor is moved to a head 40 side in a state where the water is supplied to the buffer chamber 43 of the head 40.

8 Claims, 7 Drawing Sheets

FOREIGN PATENT DOCUMENTS

| | | | |
|---|---|---|---|
| JP | 3518542 | B2 | 2/2004 |
| JP | 3518542 | B2 | 4/2004 |
| JP | 2005-118761 | A | 5/2005 |
| JP | 2007-054737 | A | 3/2007 |
| JP | 2009-106930 | A | 5/2009 |
| WO | 2009/047889 | A1 | 4/2009 |

* cited by examiner

WATER DISCHARGE DEVICE

TECHNICAL FIELD

The present invention relates to a water discharge device which can discharge water in a wide region while changing a water discharge direction.

BACKGROUND ART

Heretofore, a water discharge device has been known which can discharge water in a wide region while changing a water discharge direction. The water discharge device discharges the water while allowing a nozzle to revolve while swinging or rotate by a swirling flow formed in an inflow chamber in which the nozzle is incorporated (e.g., see Patent Document 1). Specifically, washing water is guided into the inflow chamber so that the washing water which has flowed into the inflow chamber causes the swirling flow along the inner peripheral wall face of the inflow chamber. Moreover, a force generated based on the swirling flow is exerted to the nozzle, so that the nozzle having a tilted posture performs swinging revolution around the swirling direction of the swirling flow. The water discharge device disclosed in Patent Document 1 can discharge the water in the wide region without separately disposing any device for driving the nozzle, which contributes energy saving and cost reduction.

There is suggested another water discharge device intended to perform water discharge in a wider region than the water discharge device disclosed in Patent Document 1. The water discharge device comprises a water sprinkling member having a plurality of water discharge ports at the tip of a nozzle, and water is supplied from a tip side of the nozzle to a storage chamber in the water sprinkling member, and discharged through the plurality of water discharge ports (e.g., see Patent Document 2).

[Patent Document 1] Japanese Patent No. 3518542

[Patent Document 2] Japanese Application Laid-Open No. 2009-106930

DISCLOSURE OF THE INVENTION

Problem to be Solved by the Invention

Both the water discharge device disclosed in Patent Document 1 and the water discharge device disclosed in Patent Document 2 allow a nozzle to perform a rotary movement including swinging revolution or rotation by a swirling flow formed in an inflow chamber. It is to be noted that the swinging revolution is the rotary movement including the revolution around a support point as the center of swing at which the central axis of a rotor (e.g., the nozzle) performing the swinging revolution and the central axis of the swinging revolution (e.g., the central axis of the inflow chamber) intersect. The swinging revolution is the rotary movement where one end and the other end of the rotor (e.g., the nozzle) are positioned on opposite sides via the central axis of the rotor as seen from the central axis direction of the swinging revolution.

In the water discharge device disclosed in Patent Document 2, a water sprinkling member having a larger diameter than the nozzle is disposed at the tip of the nozzle, as compared with the water discharge device disclosed in Patent Document 1. In consequence, the mass of the rotor constituted of the nozzle and the water sprinkling member increases, and a moment of inertia also tends to increase. Therefore, in the water discharge device disclosed in Patent Document 1 and the water discharge device disclosed in Patent Document 2, it is difficult for the water discharge device provided with the water sprinkling member disclosed in Patent Document 2 to acquire a sufficient rotation start-up ability especially at start-up of the device as long as a rotary mechanism similar to the above mechanism is employed.

On the other hand, to improve the only rotation start-up ability, it is considered that the moment of inertia around the central axis of the swinging revolution or the moment of inertia around the central axis of the rotation can be made small. However, when the moment of inertia around the central axis of the swinging revolution or the moment of inertia around the central axis of the rotation is made small, a centrifugal force is exerted in such a direction that the force does become large after starting the rotary movement of the swinging revolution or the rotation, which could become a factor for disturbing a rotation stability. Moreover, it can be considered that the amount of water to be introduced into the inflow chamber is increased to increase energy of the rotary movement, but such a countermeasure is not preferable from viewpoint of water saving. It is originally difficult to acquire a sufficient amount of the water at the start-up, and hence a fundamental solution is demanded.

The present invention has been developed in view of such problems, and an object thereof is to provide a water discharge device which can discharge water in a wide region while changing a water discharge direction and in which a water sprinkling member having a plurality of water discharge ports can achieve both a rotation start-up ability and a rotation stability.

Means for Solving the Problem

To achieve the above object, according to the present invention, there is provided a water discharge device which is configured to discharge water in a wide region while changing a water discharge direction, comprising (a) a guide member including therein a formed inflow chamber into which the water flows and an opening which connects the inside of the inflow chamber to the outside of the inflow chamber; (b) a tubular body including a small diameter portion having a smaller diameter than the opening and a large diameter portion having a larger diameter than the opening, the small diameter portion having a tip thereof projected to the outside of the guide member through the opening, at least the large diameter portion being disposed in the inflow chamber, the tubular body being configured to allow the water which has flowed into the inflow chamber to flow out of the tip of the small diameter portion; and (c) a water sprinkling member connected to the tip of the small diameter portion so that the water sprinkling member is positioned outside the guide member, provided with a plurality of water discharge ports and including therein a formed water storage chamber connected to the plurality of water discharge ports, respectively. The tubular body is configured to swing and revolve around the central axis of the inflow chamber while tilting from the central axis of the inflow chamber in a state where at least a part of the small diameter portion comes in contact with the opening by the water which has flowed into the inflow chamber, and is configured to rotate around the central axis of the tubular body itself. The center of gravity of a rotor constituted of the tubular body and the water sprinkling member is positioned near the opening which is located near the center of swing at which the central axis of the tubular body tilted by the swinging revolution and the central axis of the inflow chamber intersect in a state where any water is not supplied to the water storage chamber of the water sprinkling member, whereas the center of gravity of the rotor is moved to a water sprinkling member side in a state where the water is supplied to the water storage chamber of the water sprinkling member.

In the present invention, in the state where any water is not supplied to the water storage chamber of the water sprinkling member, i.e., at start-up, the center of gravity of the rotor constituted of the tubular body and the water sprinkling member is positioned near the center of swing. Therefore, at the start-up of the swinging revolution of the rotor performed by the water which has flowed into the inflow chamber, the moment of inertia of the rotor can be made small. The start-up of the swinging revolution of the rotor can smoothly be performed, and a rotation start-up ability can satisfactorily be acquired.

After the start-up, the water storage chamber of the water sprinkling member is filled with the water from the inflow chamber through the tip of the tubular body, and the water is discharged through the plurality of water discharge ports disposed in the water storage chamber. Water corresponding to the water discharged through the plurality of water discharge ports is successively supplied from the inflow chamber to the water storage chamber through the tip of the tubular body, whereby a state where the water storage chamber is filled with the water continues. In consequence, while the water is supplied to the water storage chamber of the water sprinkling member, the center of gravity of the rotor constituted of the tubular body and the water sprinkling member moves from the vicinity of the center of swing to the water sprinkling member side, whereby it is possible to increase the moment of inertia of the rotor during the swinging revolution. Therefore, the centrifugal force by the swinging revolution of the rotor can be raised, and the rotation stability of the swinging revolution can be acquired by using the centrifugal force as an inertial force.

Since the center of gravity of the rotor after the start-up moves to the water sprinkling member side from the vicinity of the opening which is located near the center of swing, the center of gravity of the rotor can be moved to the outside of the inflow chamber. Since the inflow chamber is filled with the water after the start-up, the center of gravity of the rotor can be moved to the outside of the inflow chamber to keep a high centrifugal force without being influenced by an ascending force which influences and lowers the centrifugal force if the center of gravity of the rotor is positioned on the inflow chamber side, whereby it is possible to acquire the rotation stability of the swinging revolution.

Moreover, in the water discharge device according to the present invention, the center of gravity of the rotor in the state where any water is not supplied to the water storage chamber is preferably positioned on the water sprinkling member side from the opening.

In this preferable configuration, the center of gravity of the rotor in the state where any water is not supplied to the water storage chamber is positioned on the water sprinkling member side from the opening. If the center of gravity moves to the water sprinkling member side in the state where the water is supplied to the water storage chamber of the water sprinkling member, the center of gravity of the rotor does not pass by the center of swing. When the center of gravity of the rotor moves to pass by the center of swing, the moment of inertia of the rotor decreases and then increases, and the behavior of the swinging revolution of the rotor becomes unstable. Therefore, in this preferable configuration, according to the constitution in which the center of gravity of the rotor does not pass by the center of swing, the moment of inertia of the rotor can gradually and stably be increased, and the rotating fluctuation of the rotor can be suppressed to more securely acquire the rotation stability of the swinging revolution.

Moreover, in the water discharge device according to the present invention, the water sprinkling member is provided with drain ports through which the water in the water storage chamber is discharged in a state where the water supply to the water storage chamber is preferably stopped.

In this preferably configuration, when the water sprinkling member is provided with the drain ports, the water in the water storage chamber can be discharged in the state where the water supply to the water storage chamber is stopped. When the water in the water storage chamber is discharged, the center of gravity of the rotor can securely move to the opening side, whereby the rotation start-up ability during the next water discharge can securely and satisfactorily be acquired.

Furthermore, in the water discharge device according to the present invention, preferably the water discharge ports are formed to perform a function of the drain ports, and the plurality of water discharge ports are formed with a predetermined distance therebetween near the peripheral edge of the water sprinkling member.

In this preferable configuration, drain ports do not have to be separately disposed, and the water discharge ports can be utilized as the drain ports. Moreover, the water discharge ports which perform the function of the drain ports are formed with the predetermined distance therebetween near the peripheral edge of the water sprinkling member, whereby the water in the water storage chamber can securely be discharged irrespective of the stop position of the water sprinkling member. Therefore, the water in the water storage chamber can securely be discharged to securely move the center of gravity of the rotor to the opening side, and the rotation start-up ability during the next water discharge can securely and satisfactorily be acquired.

Additionally, in the water discharge device according to the present invention, the guide member is preferably provided with drain ports through which the water in the inflow chamber is discharged in a state where the water supply to the inflow chamber is stopped.

In this preferable configuration, the drain ports through which the water in the inflow chamber is discharged can be disposed to discharge the water in the inflow chamber in the state where the water supply to the inflow chamber is stopped. The water in the inflow chamber is discharged to eliminate the ascending force exerted to the tubular body constituting the rotor, whereby the center of gravity of the rotor can be moved to the opening side. Therefore, the rotation start-up ability during the next water discharge can securely and satisfactorily be acquired. Moreover, when the ascending force is eliminated, components constituting the rotor are not made heavy but the movement/change of the center of gravity can noticeably be enlarged.

Moreover, in the water discharge device according to the present invention, preferably a space is formed between the opening and the tubular body, the water is supplied to the space so that the water performs a function of a bearing of the tubular body, and the space performs a function of the drain port.

In this preferable configuration, as the bearing between the opening of the guide member and the tubular body, any separate member is not required but the water is provided with the function of the bearing, whereby the space between the opening and the tubular body can perform the function of the drain port. Therefore, a more compact constitution can be obtained. Moreover, the water in the inflow chamber can be discharged to securely and satisfactorily acquire the rotation start-up ability during the next water discharge.

Furthermore, in the water discharge device according to the present invention, preferably the rotor constituted of the tubular body and the water sprinkling member is divided into at least two portions positioned near the opening, and the rotor is integrally formed of the divided portions.

In this preferable configuration, the rotor constituted of the tubular body and the water sprinkling member is divided into the portions positioned near the opening, whereby the water sprinkling member side and the tubular body side, which easily become comparatively heavy, can easily be formed as separate components by changing materials or thicknesses, respectively. The center of gravity of the rotor can easily be set near the opening.

Moreover, in the water discharge device according to the present invention, the outer periphery of the water sprinkling member is preferably formed so that the diameter of the outer periphery becomes larger than that of the large diameter portion of the tubular body.

In this preferable configuration, the diameter of the water sprinkling member is set to be larger than that of the large diameter portion of the tubular body, whereby the water storage chamber can be provided with a large diameter, which can further enlarge the moment of inertia in the case where the water storage chamber is filled with the water. Therefore, when the rotor rotates, the water sprinkling member performs a function of a fly wheel, whereby the rotation stability can be acquired.

Effect of the Invention

According to the present invention, there can be provided a water discharge device which can perform water discharge in a wide region while changing a water discharge direction and in which a water sprinkling member having a plurality of water discharge ports can simultaneously achieve both a rotation start-up ability and a rotation stability.

BEST MODE FOR CARRYING OUT THE INVENTION

Figure 1:
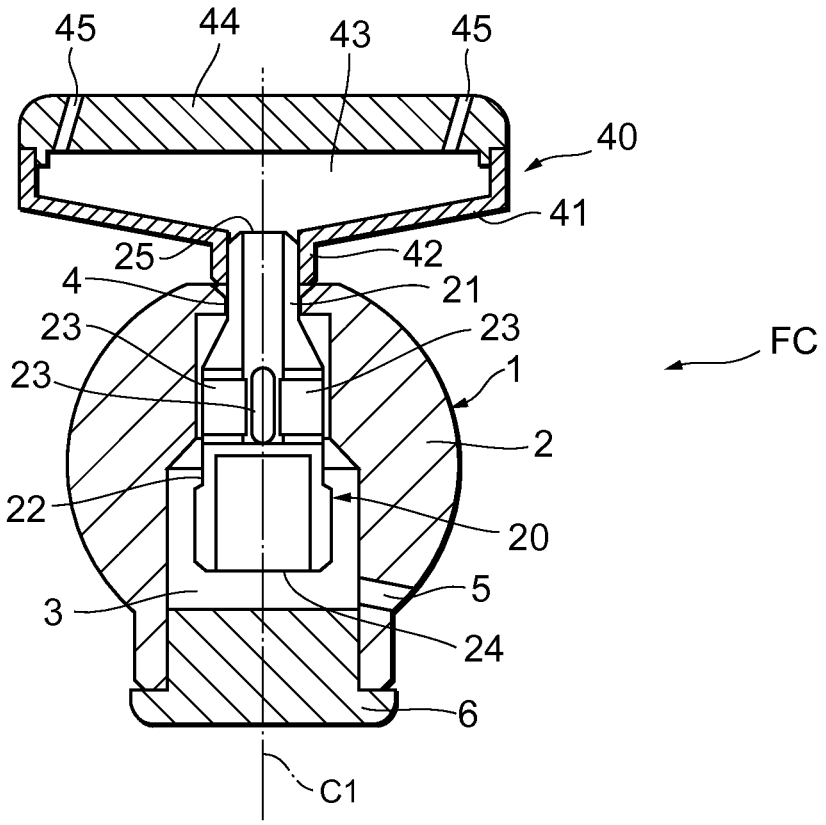
FIG. 1 is an exemplary sectional view of a water discharge device according to the present invention.

Hereinafter, an embodiment of the present invention will be described with reference to accompanying drawings. To facilitate understanding of the description, the same constituent element is denoted with the same reference numeral, if possible, in the drawings, and redundant description is omitted.

FIG. 1 shows an exemplary sectional view of a water discharge device according to an embodiment of the present invention. As shown in FIG. 1, a water discharge device FC of the present embodiment mainly comprises a guide member 1, a tubular body 20 and a head 40 (a water sprinkling member).

The guide member 1 has a structure in which a through hole is formed in a spherical portion 2. In the spherical portion 2, an inflow chamber 3 is formed as a revolution chamber extending along a diametric direction of the spherical portion 2. In one end of the inflow chamber 3 along an axial direction, an opening 4 connected to the inside and outside of the inflow chamber 3 is disposed. An inner diameter dimension of the opening 4 is smaller than that of the inflow chamber 3. A central axis of the opening 4 matches that of the inflow chamber 3.

On the side of the other end of the inflow chamber 3 along the axial direction, an inflow hole 5 is diametrically outwardly formed. The inflow hole 5 is connected to the inside of the inflow chamber 3 and the outside of the spherical portion 2. Water guided from the outside of the guide member 1 to the inflow hole 5 flows into the inflow chamber 3 through the inflow hole 5 in a tangent direction. In the inflow chamber 3, a swirling flow of water is formed. The opening 4 is opened to the outside of the guide member 1, and the opening in the other end of the inflow chamber 3 is closed with a sealing member 6.

The tubular body 20 is formed schematically in a bottle-like shape having a small diameter portion 21 and a large diameter portion 22. An outer diameter dimension of the large diameter portion 22 is smaller than an inner diameter dimension of the inflow chamber 3. The large diameter portion 22 is disposed in the inflow chamber 3. An outer diameter dimension of the small diameter portion 21 disposed integrally with the large diameter portion 22 is smaller than an inner diameter dimension of the opening 4. The small diameter portion 21 extends through the opening 4 so that a tip of the small diameter portion projects outwardly from the spherical portion 2.

As shown in FIG. 1, while the central axes of the tubular body 20 and the inflow chamber 3 are matched with each other, a space is formed between the outer peripheral surface of the small diameter portion 21 and the inner wall surface of the opening 4. Furthermore, a space is also formed between the outer peripheral surface of the large diameter portion 22 and the inner wall surface of the inflow chamber 3. The tubular body 20 is not fixed to the guide member 1, and hence can freely rotate or perform swinging revolution involving oscillation.

Both ends of the tubular body 20 in the axial direction are opened, and the water flowing into the tubular body 20 through an opening 24 on a large diameter portion 22 side flows through the tubular body 20 in the axial direction. The water can flow out of the tubular body 20 through an opening 25 on a small diameter portion 21 side. Moreover, in the peripheral surface (the side surface) of the large diameter portion 22 of the tubular body 20, a plurality of through holes 23 are intermittently arranged at an equal interval in a peripheral direction. The water flowing into the inflow chamber 3 is guided into the tubular body 20 also through the through holes 23, so that the water can flow out of the tubular body through the opening 25 in the tip of the small diameter portion 21.

The head 40 is connected to the tip of the small diameter portion 21 of the tubular body 20 so that the head is positioned outside the guide member 1. The head 40 is formed in a flat shape and has a diametric dimension larger than the tubular body 20. The center of the head 40 in the diametric direction is matched with a central axis C1 of the tubular body 20. The head 40 includes a buffer member 41 having a funnel-like shape and a water sprinkling plate 44. The tip of the small diameter portion 21 of the tubular body 20 is fitted and fixed into a thin tube portion 42 of the buffer member 41. In consequence, both the tubular body 20 and the head 40 can, as an integral rotor, freely rotate, or perform swinging revolution involving oscillation.

In the buffer member 41, a buffer chamber 43 (a water storage chamber) is formed, and the opening 25 in the tip of the small diameter portion 21 of the tubular body 20 is opposed to the buffer chamber 43. The diametric dimension of the buffer chamber 43 is larger than that of the tubular body 20. The buffer chamber 43 can temporarily receive the water which has flowed out of the tubular body through the tip of the small diameter portion 21. It is to be noted that the buffer chamber 43 may comprise a mechanism which regulates the direction of the water flowing out of the tubular body through the tip of the small diameter portion 21 in another preferable configuration.

The water sprinkling plate 44 is disposed in the form of a lid which closes an opening of the buffer chamber 43 on a side opposite to the thin tube portion 42, The water sprinkling plate 44 is formed in a disc-like shape having a diametric direction larger than that of the tubular body 20. The water sprinkling plate 44 is provided with a plurality of water discharge holes 45 (water discharge ports) extending through the plate in a thickness direction thereof. One end of each of the water discharge holes 45 is connected to the buffer chamber 43, and the other end thereof is opposed to the outside of the head 40.

The plurality of water discharge holes 45 are formed along a peripheral direction in at least an outer peripheral side portion of the water sprinkling plate 44. Each of the water discharge holes 45 in the axial direction is not parallel to the central axis C1 of the tubular body 20, and is tilted. In the present embodiment, all the water discharge holes 45 are tilted in the same direction. Therefore, the water discharge holes 45 are tilted in an asymmetric relation with respect to the central axis C1 of the tubular body 20. That is, the tilt direction of the water discharge holes 45 around the central axis C1 of the tubular body 20 after the water sprinkling plate 44 is rotated by 180 degrees around the central axis C1 of the tubular body 20 does not match with the tilt direction of the water discharge holes 45 before the water sprinkling plate is rotated.

The tubular body 20 and the head 40 are assembled and integrally formed. The small diameter portion 21 and the large diameter portion 22 of the tubular body 20 are also integrally formed. The tubular body 20 and the head 40 are formed of separate members and are integrally assembled. The small diameter portion 21 and the large diameter portion 22 of the tubular body 20 may be formed of separate members and integrally assembled. The center of gravity of the rotor constituted of the tubular body 20 and the head 40 is preferably positioned outside the inflow chamber 3, when the rotor is disposed in the inflow chamber 3.

In this case, the head 40 has a larger diameter than the tubular body 20, and the head 40 is enlarged in the diametric direction, whereby a mass of the tubular body 20 is larger than that of the head 40, and the center of gravity is preferably positioned outside the inflow chamber 3. On the other hand, the head 40 is preferably made of a material such as a resin having a small specific gravity, whereas the tubular body 20 is made of a material such as a metal having a large specific gravity. In this way, the head 40 and the tubular body 20 can easily be formed as separate members, whereby materials and thicknesses thereof can easily be changed, preferably, and the center of gravity of the rotor can easily be set near the opening 4.

The large diameter portion 22 preferably has a lighter weight than the small diameter portion 21 so that the center of gravity is positioned outside the inflow chamber. Therefore, as the material of the large diameter portion 22, a material having a smaller density than the material of the small diameter portion 21 may be used. For example, a resin is preferably used for the large diameter portion 22, whereas a metal is used for the small diameter portion 21. When the portions are integrally formed, a water passage of the large diameter portion 22 of the tubular body 20 has a larger sectional area than a water passage of the small diameter portion 21, and the thickness of the large diameter portion 22 is small, whereby the mass of the large diameter portion 22 may be smaller than that of the small diameter portion 21 so that the center of gravity is positioned outside the inflow chamber.

Figure 2:
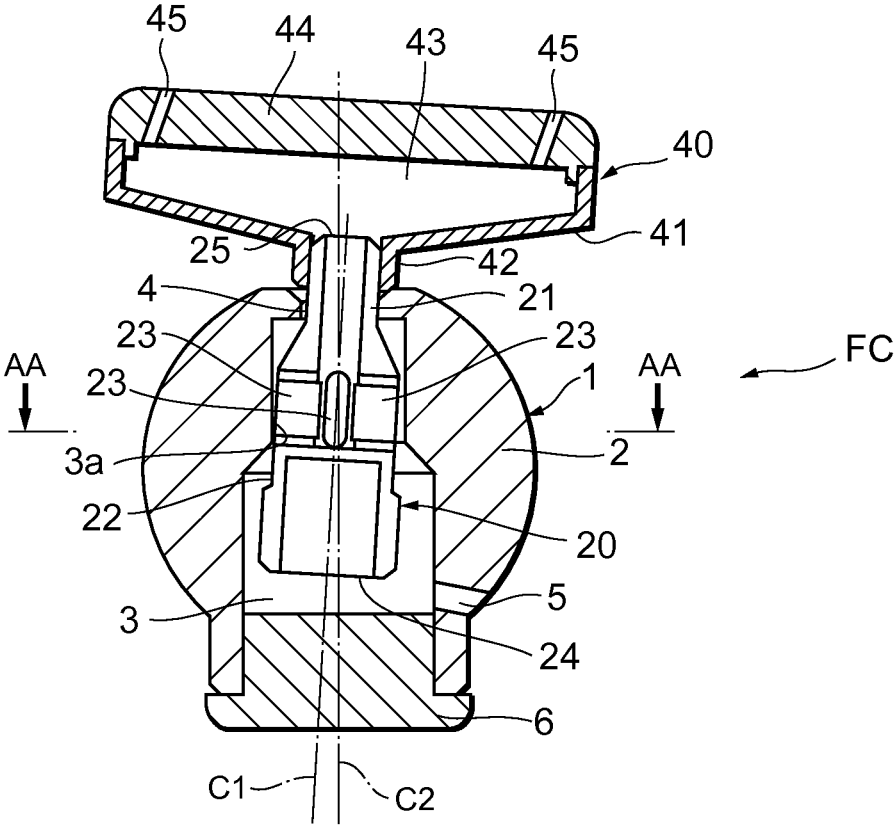
FIG. 2 is an exemplary sectional view similar to FIG. 1, showing a state where a tubular body and a head are inclined with respect to a central axis of an inflow chamber.
Figure 3:
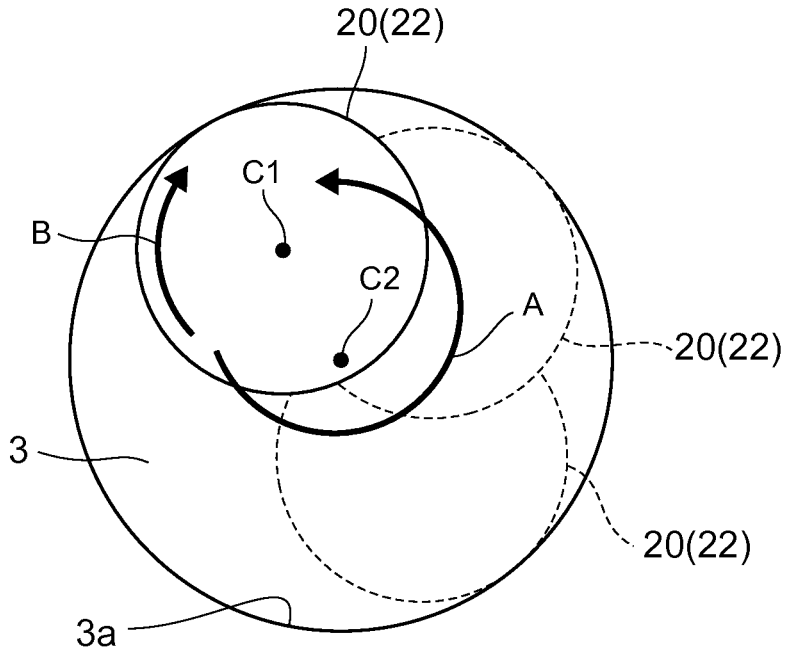
FIG. 3 is an exemplary diagram corresponding to a section cut along the AA-AA line of FIG. 2 and showing the inflow chamber and the tubular body (a large diameter portion) disposed in this chamber as seen from a planar direction.

In the present embodiment, the rotor constituted of the tubular body 20 and the head 40 is configured to perform the swinging revolution while tilting from the central axis of the inflow chamber 3. FIG. 2 shows a state where the rotor constituted of the tubular body 20 and the head 40 are tilted. Moreover, FIG. 3 shows a diagram corresponding to a section cut along the AA-AA line of FIG. 2 and shows an exemplary diagram of the inflow chamber 3 and the tubular body 20 (the large diameter portion 22) disposed in the chamber as seen from a planar direction.

The water guided through a piping line (not shown) or the like flows into the inflow chamber through the inflow hole 5 formed in the guide member 1 in a tangent direction with respect to the inflow chamber 3 having a substantially round section shape. In consequence, the flow of washing water swirling around a central axis C2 of the inflow chamber 3 is formed in the inflow chamber 3.

The tubular body 20 (the large diameter portion 22) disposed in the inflow chamber 3 receives force of the above swirling flow. In consequence, while the tubular body tilts from the central axis C2 of the inflow chamber 3 as shown in FIG. 2, the tubular body performs the swinging revolution around the central axis C2 of the inflow chamber 3, for example, in a direction shown by an arrow A in FIG. 3. A part of the small diameter portion 21 of the tubular body 20 comes in contact with the opening 4, and a part of the side surface (the peripheral surface) of the large diameter portion 22 comes in contact with a guide face 3*a* of the inflow chamber 3, whereby a further tilt of the tubular body 20 from the central axis C2 of the swirling chamber (the inflow chamber) 3 is regulated.

In the present description, when the tubular body 20 revolves around the central axis C2 while tilting from the central axis C2 of the inflow chamber 3, this movement is referred to as 'swinging revolution'. That is, when the tubular body 20 performs the swinging revolution around the central axis C2 while tilting from the central axis C2 of the inflow chamber 3, the tubular body 20 oscillates as if the tip of the small diameter portion 21 swings around the vicinity of a portion of the small diameter portion 21 which comes into contact with the opening 4. In this way, the swinging revolution is a rotary movement of swirling around a support point which is the center of swing at which the central axis C1 of the swinging revolution rotor (the tubular body 20 and the head 40 in the present embodiment) and the central axis C2 of the inflow chamber 3 as the central axis of the swinging revolution intersect. As seen from the central axis C2 direction of the swinging revolution, the swinging revolution is a rotary movement where one end of the rotor constituted of the tubular body 20 and the head 40 (the center of the water sprinkling plate 44) and the other end of the rotor (the center of the large diameter portion 22) are positioned on opposite sides via the central axis C2.

When the tubular body 20 makes the swinging revolution, a part of the outer peripheral wall of the small diameter portion 21 comes in contact with the inner wall surface of the opening 4, and a part of the side surface (the peripheral surface) of the large diameter portion 22 comes in the guide face 3*a* of the inflow chamber 3, whereby a dynamic frictional force generated in these contact portions is exerted to the tubular body 20. Owing to this dynamic frictional force, instead of moving through the inflow chamber 3 while sliding in the contact state where the tubular body does not change a contact position thereof with respect to the opening 4 and the guide face 3*a*, the tubular body 20 makes the swinging revolution while rolling along the inner wall surface and the guide face 3*a*. When the tubular body 20 rolls along the inner wall surface of the opening 4 and the guide face 3*a*, the tubular body 20 rotates around the central axis C1 thereof.

That is, while rotating around the central axis C1 of the tubular body 20 itself, the tubular body makes the swinging revolution around the central axis C2 of the inflow chamber 3. The revolving direction of the tubular body 20 around the central axis C2 of the inflow chamber 3 (the arrow A direction in FIG. 3) is the same as the swirling direction of the swirling flow formed in the inflow chamber 3. The rotating direction around the central axis C1 of the tubular body 20 itself (an arrow B direction in FIG. 3) is reverse to the revolving direction A. It is to be noted that concerning this rotation, the rotating direction or the number of rotations can be controlled in accordance with the dynamic friction coefficient of the contact face, the material or shape of the large diameter portion 22 of the tubular body 20, the inflow speed of the water through the inflow hole 5, a space between the inflow chamber 3 and the large diameter portion 22 and the like.

Furthermore, when the tubular body 20 is allowed to rotate with a less amount of the washing water, a centrifugal force by the revolution which influences the dynamic frictional force needs to be efficiently obtained. However, the revolution number which becomes large in proportion to the amount of the washing water lowers with the less amount of the washing water. When the centrifugal force is to be efficiently obtained with the less amount of the washing water, the position of the center of gravity of the tubular body 20 is preferably positioned outside the inflow chamber 3, i.e., in the air. In consequence, the tubular body 20 is not influenced by an ascending force but can efficiently obtain the centrifugal force. Furthermore, the tubular body 20 disposed outside the inflow chamber 3, i.e., in the air is not influenced by the ascending force on the side of the position of the center of gravity of the tubular body, whereby the centrifugal force can efficiently be obtained without enlarging the shape of the tubular body.

Furthermore, the present embodiment has a constitution where when any water is not supplied to the buffer chamber 43 of the head 40, the center of gravity of the rotor constituted of the tubular body 20 and the head 40 is positioned near the opening 4 which is located near the center of swing at which the central axis C1 of the tubular body 20 tilted by the swinging revolution and the central axis C1 of the inflow chamber 3 intersect. On the other hand, when the water is supplied to the buffer chamber 43 of the head 40, the center of gravity of the rotor constituted of the tubular body 20 and the head 40 is moved to the head 40 side.

In the state where any water is not supplied to the buffer chamber 43 of the head 40, i.e., at start-up, the center of gravity of the rotor constituted of the tubular body 20 and the head 40 is positioned near the center of swing. In consequence, the moment of inertia of the rotor at the start-up of the swinging revolution of the rotor can be made small, and the start-up of the swinging revolution of the rotor is smoothly performed, whereby rotation start-up ability can satisfactorily be acquired.

After the start-up, the buffer chamber 43 of the head 40 is filled with the water from the inflow chamber 3 through the opening 25 disposed at the tip of the tubular body 20, and the water is discharged through the plurality of water discharge holes 45 disposed in the buffer chamber 43. Water corresponding to the water discharged through the plurality of water discharge holes 45 is successively supplied from the inflow chamber 3 to the buffer chamber 43 through the opening 25 of the tubular body 20, whereby a state where the buffer chamber 43 is filled with the water continues. In consequence, while the water is supplied to the buffer chamber 43 of the head 40, the center of gravity of the rotor constituted of the tubular body 20 and the head 40 moves from the vicinity of the center of swing to the head 40 side, whereby it is possible to increase the moment of inertia of the rotor during the swinging revolution. Therefore, the centrifugal force by the swinging revolution of the rotor can be raised, and the rotation stability of the swinging revolution can be acquired by using the centrifugal force as an inertial force.

Moreover, when the buffer chamber 43 of the head is filled with the water after the start-up, the mass of the rotor increases, which increases the moment of inertia around the central axis of the rotation. Therefore, after the start-up, the rotation stability of this rotation also improves.

Since the center of gravity of the rotor after the start-up moves to the head 40 side from the vicinity of the opening 4 which is located near the center of swing, the center of gravity of the rotor can be moved to the outside of the inflow chamber 3. Since the inflow chamber 3 is filled with the water after the start-up, the center of gravity of the rotor can be moved to the outside of the inflow chamber 3 to keep a high centrifugal force without being influenced by the ascending force which influences and lowers the centrifugal force if the center of gravity of the rotor is positioned on the inflow chamber 3 side, whereby it is possible to acquire the rotation stability of the swinging revolution.

Moreover, in the water discharge device FC of the present embodiment, the center of gravity of the rotor in the state where any water is not supplied to the buffer chamber 43 is preferably positioned on the head 40 side from the opening 4. According to such a constitution, even if the center of gravity moves to the head 40 side in the state where the water is supplied to the buffer chamber 43, the center of gravity of the rotor does not pass by the center of swing. When the center of gravity of the rotor moves to pass by the center of swing, the moment of inertia of the rotor decreases and then increases, whereby the behavior of the swinging revolution of the rotor becomes unstable. Therefore, according to the constitution where the center of gravity of the rotor does not pass by the center of swing, the moment of inertia of the rotor can gradually and stably be increased, and the rotating fluctuation of the rotor can be suppressed to more securely acquire the rotation stability of the swinging revolution.

Furthermore, in the water discharge device FC of the present embodiment, the water discharge holes 45 are formed to perform a function of drain ports for discharging the water from the buffer chamber 43, and the plurality of water discharge holes 45 are formed with a predetermined distance therebetween near the peripheral edge of the head 40. The water discharge holes 45 as these drain ports are formed so that the water in the buffer chamber 43 is discharged in a state where the water supply to the buffer chamber 43 is stopped.

When the water in the buffer chamber 43 is discharged, the center of gravity of the rotor can securely be moved to the opening 4 side. Therefore, the rotation start-up ability during the next water discharge can securely and satisfactorily be acquired. Moreover, the plurality of water discharge holes 45 performing the function of the drain ports are formed with the predetermined distance therebetween near the peripheral edge of the head 40, whereby the water in the buffer chamber 43 can securely be discharged irrespective of the stop position of the head 40.

Furthermore, in the water discharge device FC of the present embodiment, the space is formed between the opening 4 and the tubular body 20, and the water is supplied to this space so that the water performs a function of a bearing of the tubular body 20. This space between the tubular body 20 and the opening 4 is provided with a function of the drain port through which the water in the inflow chamber 3 is discharged. Through the space as the drain port between the tubular body 20 and the opening 4, the water in the inflow chamber 3 is discharged in the state where the water supply to the inflow chamber 3 is stopped.

Since there are provided the drain ports through which the water in the inflow chamber 3 is discharged, the water in the inflow chamber 3 can be discharged in the state where the water supply to the inflow chamber 3 is stopped. The water in the inflow chamber 3 is discharged to eliminate the ascending force exerted to the tubular body 20 constituting the rotor, whereby the center of gravity of the rotor can be moved to the opening 4 side. Therefore, the rotation start-up ability during the next water discharge can securely and satisfactorily be acquired. Moreover, when the ascending force is eliminated, components constituting the tubular body 20 and the head 40 as the rotor are not made heavy but the movement/change of the center of gravity can noticeably be enlarged. Furthermore, as the bearing between the opening 4 of the guide member 1 and the tubular body 20, any separate member is not required but the water is provided with the function of the bearing, whereby the space between the opening 4 and the tubular body 20 can perform the function of the drain port. Therefore, a more compact constitution can be obtained.

Moreover, in the water discharge device FC of the present embodiment, the outer periphery of the head 40 is formed so that the diameter thereof becomes larger than that of the large diameter portion 22 of the tubular body 20. According to such a constitution, the diameter of the buffer chamber 43 can be made large, which can further enlarge the moment of inertia in the case where the buffer chamber 43 is filled with the water. Therefore, when the tubular body 20 and the head 40 as the rotor rotates, the head 40 performs a function of a fly wheel, and hence the rotation stability can be acquired.

Next, motion (locus) of the shower flow of the water discharge device FC of the present embodiment will be described.

A part of the washing water which has flowed into the inflow chamber 3 flows into the tubular body 20 through the opening 24 in the tip of the tubular body 20 on the large diameter portion 22 side and the through holes 23 formed in the side surface of the tubular body, and flows toward the tip of the small diameter portion 21 along the axial direction of the tubular body 20. Subsequently, the water which has flowed out of the small diameter portion 21 through the opening 25 flows into the buffer chamber 43 of the head 40. When the water in the inflow chamber 3 flows into the tubular body 20 to flow through the tubular body 20, the water still has a swirling component. Moreover, when the water flows through the small diameter portion 21 which is a comparatively small flow path, a flow speed increases.

The buffer chamber 43 is a flat space having a large diametric dimension as compared with the inflow chamber 3 and the tubular body 20, and hence energy of the water flowing through the opening 25 of the small diameter portion 21 can be absorbed. That is, any special mechanism or component is not added but the water is temporarily received in the buffer chamber 43 only, whereby the flow speed of the water can noticeably be lowered and the swirling component can be lost. The water rectified in the buffer chamber 43 in this manner is discharged in a shower-like state to the outside through the plurality of water discharge holes 45 connected to the buffer chamber 43.

Since the tubular body 20 and the head 40 make a movement which is a combination of the swinging revolution and the rotation as described above, the water discharge locus of the shower-like flow obtained by the water discharge device FC of the present embodiment (e.g., a movement locus, on the surface of a human body, of a collision portion of shower flow with respect to the human body or the like) is a combination of a locus of rotation and a locus of swinging revolution).

Figure 4:
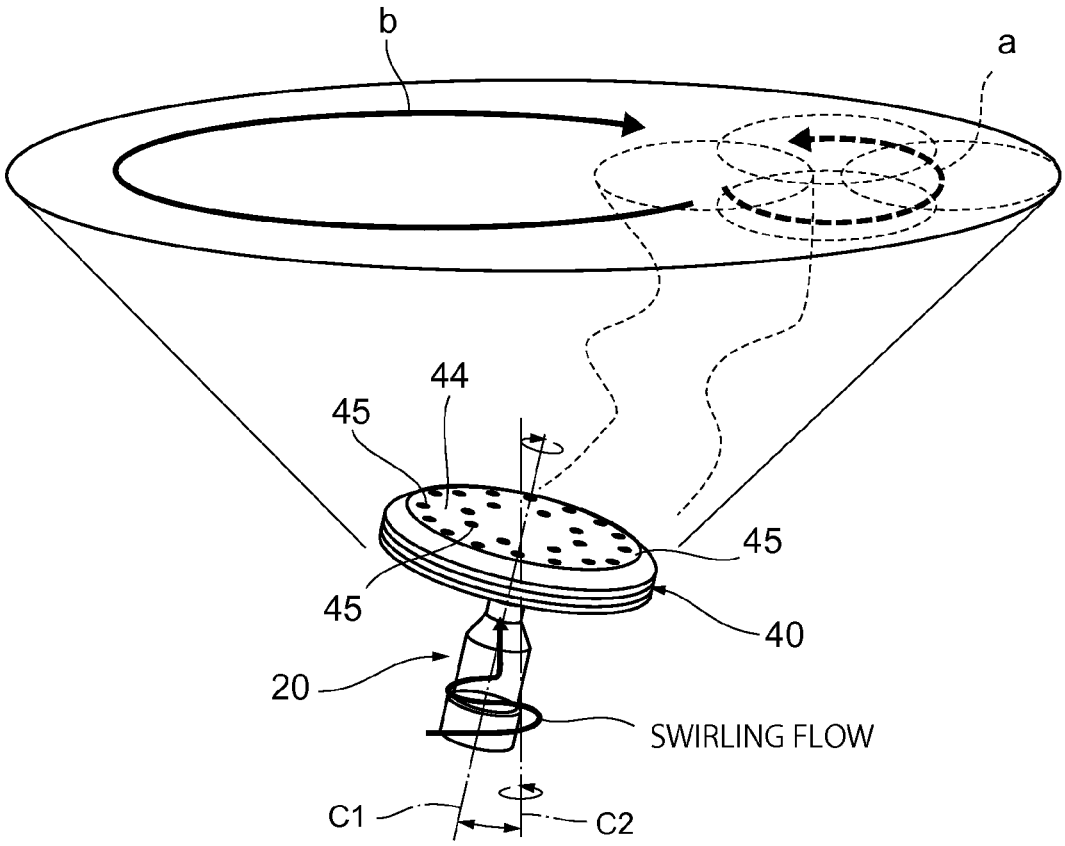
FIG. 4 is an exemplary diagram explaining a behavior of a shower flow discharged from the water discharge device shown in FIG. 1.

The water discharge locus is schematically shown in FIG. 4. It is to be noted that in FIG. 4, as to the water discharge device, the only tubular body 20 and head 40 as movable portions are shown, and the guide member 1 provided with the inflow chamber 3 is omitted.

The integral rotation of the tubular body 20 and the head 40 around their own central axis C1 forms the shower flow which moves in the same b-direction as the rotating direction while drawing a circular locus shown by a solid line in FIG. 4. Here, the water discharge holes 45 tilt from the central axis C1 of the tubular body 20, and hence the shower flow moves while drawing a circle having a diameter larger than the water sprinkling plate 44 provided with the water discharge holes 45, In the present embodiment, since the plurality of water discharge holes 45 tilt in an asymmetric relation with respect to the central axis C1, the shower flow of the water having asymmetric spread with respect to the central axis C1 is discharged. With the rotation of the tubular body 20 and the head 40 around the central axis C1, a portion where the shower flow hits the human body or the like moves around the central axis C1, and the shower flow can be sprayed over a comparatively broad region.

The expression that the plurality of water discharge holes 45 tilt in the asymmetric relation with respect to the central axis C1 includes a structure where all the water discharge holes 45 tilt in the same direction but also a structure where at least one water discharge hole 45 tilts in a direction different from that of the other water discharge hole 45. However, when the plurality of water discharge holes 45 have different tilt directions, the reach places of the shower flow are easily scattered, and such a sense that the shower flow evenly hits a certain plane (the sense of unity of shower flow) cannot easily be obtained.

On the other hand, when all the water discharge holes 45 tilt in the same direction, the shower flow from the water discharge holes 45 travels in the same direction. Therefore, the shower flow is not scattered, the shower flow providing the sense of unity in an even in-plane distribution can be sprayed, and a portion which receives the shower flow can evenly be washed or warmed. Moreover, when the scattering of the shower flow is suppressed, heat of the shower flow is prevented from being released in the air to suppress temperature drop during flying of the shower flow.

The water which has flowed into the inflow chamber 3 not only swirls to allow the rotation and swinging revolution of the tubular body 20 but also itself passes through the tubular body 20 and the head 40 to form the shower flow to be discharged through the water discharge holes 45. Here, when the washing water having the swirling component reaches the water discharge holes 45, the water is also scattered in a direction other than the tilt direction of the water discharge holes 45 when discharged, which easily forms the shower flow which has an uneven in-plane distribution and cannot provide any sense of unity.

To solve the problem, in the present embodiment, the buffer chamber 43 is disposed between the tubular body 20 and the water sprinkling plate 44, and the water can temporarily be received in the buffer chamber 43 to noticeably lower the flow speed of the water, thereby losing the swirling component. When the water passing through the water discharge holes 45 loses the swirling component, the water can securely be discharged in the tilt direction of the water discharge holes 45, and the scattering of the shower flow can be prevented to obtain the shower flow having the even in-plane distribution and providing the sense of unity.

When the water discharge holes 45 are formed, for example, near the center of the water sprinkling plate 44, it is feared that the washing water which has flowed out of the tubular body 20 through the opening 25 is not subjected to a sufficient rectifying operation in the buffer chamber 43 but flows into the head through the water discharge holes 45 together with the swirling component. Therefore, the water discharge holes 45 are preferably formed in the outer peripheral portion of the water sprinkling plate 44 if possible. Moreover, when the water discharge holes 45 are formed in the outer peripheral portion of the water sprinkling plate 44, the shower flow of the water can be discharged in a wider region by the centrifugal force generated by the above rotation and swinging revolution.

Moreover, in the present embodiment, the swinging revolution of the tubular body 20 and the head 40 around the central axis C2 of the inflow chamber 3 forms the shower flow which moves in a comparatively small region as shown by a dotted line in FIG. 4. A rotation angle determined by the tilt of the water discharge holes 45 is set to be larger than a revolution angle regulated by the tubular body 20 and the guide face 3*a*. In consequence, the shower flow formed by the swinging revolution moves in a region smaller than the movement region of the shower flow formed by the rotation in an a-direction reverse to the movement direction b of the shower flow formed by the rotation at a speed higher than that of the movement along the b-direction. Therefore, while moving in the comparatively small region along the arrow-a direction at a high speed as shown in FIG. 4, the shower flow entirely moves in a region larger than the above movement region along the b-direction reverse to the a-direction slowly.

The shower flow formed by the swinging revolution can cover an inner region which cannot be covered only with the shower flow formed by the rotation. The shower flow does not have a so-called void portion, and an even planar shower flow can be obtained. Thus, according to the present embodiment, it is possible to realize a shower flow which covers a broader region of planar shower without any void portion. If a plurality of such water discharge devices according to the present embodiment are attached to walls of, for example, a bathroom or a shower booth and the shower flow is sprayed from these water discharge devices, a large part of the human body can evenly be warmed at once in a free hand state. A sufficient bathing sense can be obtained only with the shower flow and water discharge flow. Unlike soaking in a bathtub, such shower bathing does not provide any fear of feeling of oppression of a hydraulic pressure onto the body (burden onto heart and lungs) or drowning, and gives feeling of security especially to small children or elderly people.

Figure 5:
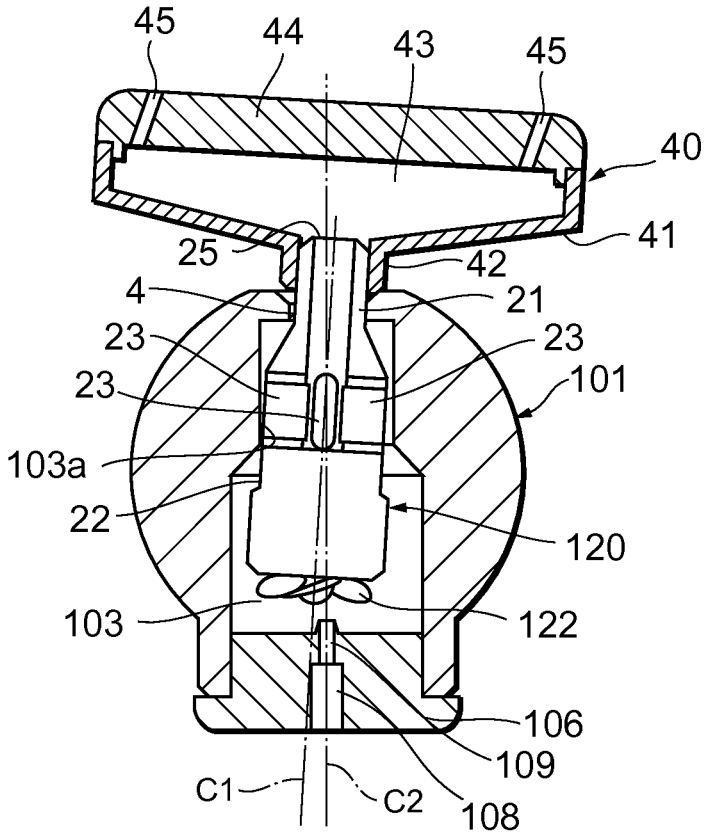
FIG. 5 is an exemplary diagram illustrating a water discharge device according to a modification of the present embodiment.
Figure 6:
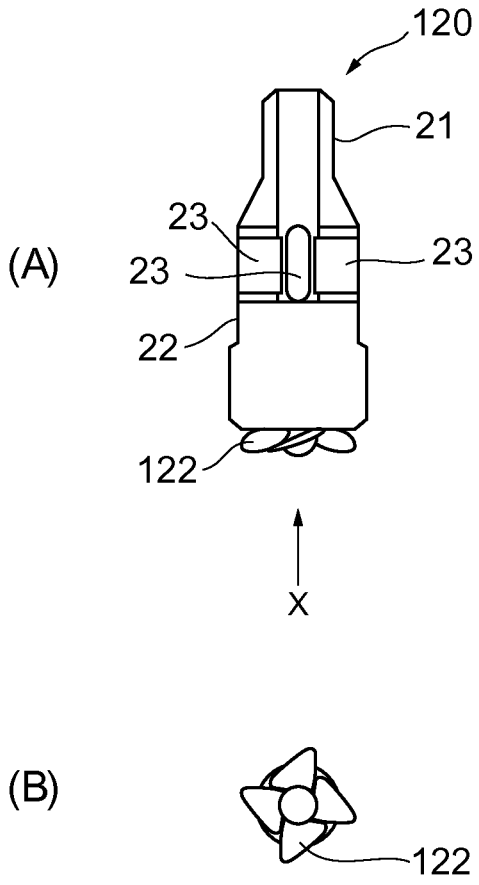
FIG. 6 is an exemplary diagram showing a tubular body of the water discharge device of the present modification.

FIG. 5 is an exemplary diagram illustrating a water discharge device according to a modification of the present embodiment. Moreover, FIG. 6 is an exemplary diagram showing a tubular body of the water discharge device of the present modification. It is to be noted that FIG. 6(*a*) is a side surface exemplary diagram of the tubular body of the water discharge device of the present modification as seen from the side surface, and FIG. 6(*b*) is an exemplary plan view of the tubular body of FIG. 6(*a*) seen along an arrow-X direction.

In the water discharge device of the present modification, energy which causes swinging revolution and rotation of the tubular body is directly imparted from a fluid (water) to the tubular body. Therefore, in the water discharge device of the present modification, in a guide member 101, there is formed a cylindrical inflow chamber 103 into which the water flows. The water flows into the inflow chamber 103 through an inflow path 109 formed in a sealing member 106. Therefore, unlike the inflow chamber 3 shown in FIG. 1, the inflow chamber 103 is not provided with an inflow hole 5. The inflow path 109 is connected to the center of the inflow chamber 103. Moreover, the sectional path area of the inflow path 109 is smaller than that of a path 108 through which the fluid is guided into the inflow chamber 103. Therefore, the flow speed of the water flowing into the inflow chamber 103 can be raised.

As shown in FIG. 6, a tubular body 120 of the water discharge device of the present modification has a schematically bottle-like shape including a small diameter portion 21 and a large diameter portion 22 in the same manner as in the tubular body 20 shown in FIG. 1. The tubular body 120 on the large diameter portion 22 side is not opened. Therefore, in the present modification, washing water which has flowed into the inflow chamber 103 can be guided into the tubular body 120 via through holes 23 to flow out of the tip of the small diameter portion 21.

Subsequently, the water which has flowed out of the tip of the small diameter portion 21 flows into a buffer chamber 43 in a head 40. The buffer chamber 43 is a flat space having a larger diametric dimension as compared with the inflow chamber 103 and the tubular body 120, and hence energy of the water flowing through the tip of the small diameter portion 21 can be decreased. That is, any special mechanism or component is not added but the water is temporarily received in the buffer chamber 43, whereby the flow speed of the water can noticeably be lowered, and a swirling component can be lost. The water rectified in the buffer chamber 43 in this manner can be discharged like a shower to the outside through a plurality of water discharge holes 45 connected to the buffer chamber 43.

Moreover, the tubular body 120 includes an axial flow blade 122 at the lower end of the large diameter portion 22. The axial flow blade 122 directly receives the flow of the water flowing from the inflow path 109 to the inflow chamber 103 to change this flow into a drive force of the tubular body 120. Since the water flows from the inflow path 109 having a small diameter into the inflow chamber 103, the water hits the axial flow blade 122 at a high flow speed. Therefore, the tubular body 120 receives a large drive force to revolve, and rotates around a central axis C1 of the tubular body 120 itself by a frictional force generated in the tubular body 120. It is to be noted that another structure is similar to the structure of the water discharge device described above with reference to FIG. 1 to FIG. 4.

The behavior of the tubular body 120 will further be described in detail. When the water is supplied to the inflow chamber 103 through the inflow path 109, the internal pressure of the inflow chamber 103 rises, and a part of the outer peripheral surface of the small diameter portion 21 is pressed onto the inner wall surface of the opening 4. Moreover, a part of the side surface (the peripheral surface) of the large diameter portion 22 is pressed onto a guide face 103*a*. Moreover, the axial flow blade 122 converts the flow of the water to the inflow chamber 103 into a drive force, and hence the tubular body 120 receives this drive force to cause a swinging revolution movement around a central axis C2 of the inflow chamber 103. When such a revolution movement is caused, a frictional force is generated in a contact portion of the small diameter portion 21 and an opening 4 and a contact portion of the large diameter portion 22 and the inflow chamber 103. Upon receiving this frictional force, the tubular body 120 starts a rotation movement about the central axis C1 of the tubular body 120 itself in the inflow chamber 103.

Even when instead of a swirling flow, the axial flow blade 122 converts the flow of the water to the inflow chamber 103 into the drive force as in the water discharge device of the present modification, the shower flow formed by the swinging revolution can cover an inner region which cannot be covered only by the shower flow formed by the rotation. Therefore, the shower flow does not have a so-called void portion, and an even planar shower flow can be obtained. In this way, also in the present modification, it is possible to realize a shower flow of shower-like water which does not have any void portion and planarly covers a wider region. Moreover, the plurality of water discharge holes 45 tilt in an asymmetric relation with respect to the central axis C1, and hence, as described above, the shower flow of the water having an asymmetric spread with respect to the central axis C1 is discharged. With the rotation of the tubular body 120 and the head 40 around the central axis C1, a portion of the shower flow hitting a human body or the like moves around the central axis C1, and the shower flow can be sprayed over a comparatively wide region.

Figure 7:
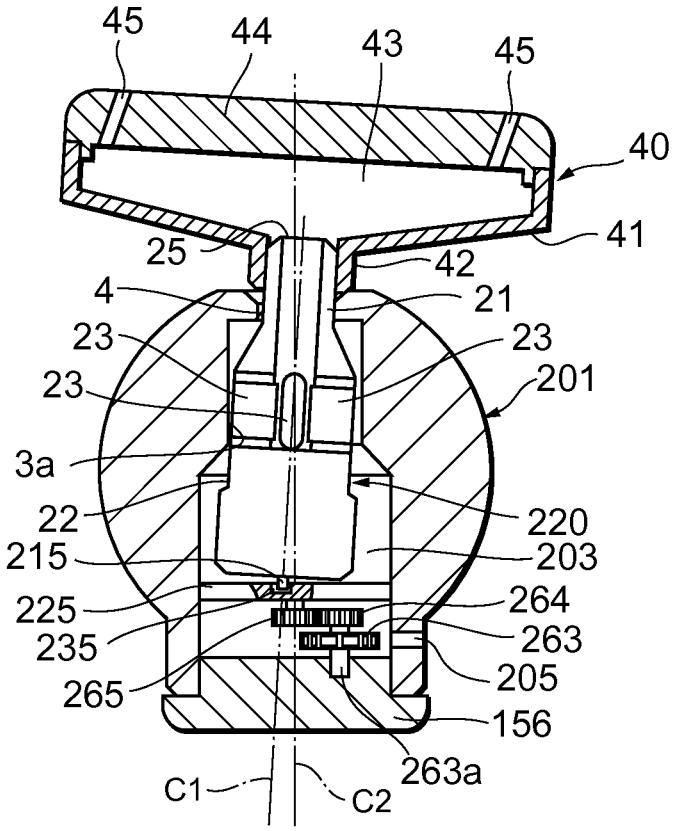
FIG. 7 is an exemplary diagram illustrating a water discharge device according to another modification of the present embodiment.

FIG. 7 is an exemplary diagram illustrating a water discharge device according to another modification of the present embodiment. The water discharge device of the present modification drives a waterwheel and a gear by water flow to cause swinging revolution and rotation of a tubular body. Therefore, the water discharge device of the present modification directly imparts energy for causing the swinging revolution and rotation of the tubular body from a fluid (water) to the tubular body. In the water discharge device of the present modification, a cylindrical inflow chamber 203 into which the water flows is formed in a guide member 201. The water flows into the inflow chamber 203 through an inflow hole 205 formed in the inflow chamber 203. The inflow hole 205 may be formed to tilt as in the inflow hole 5 shown in FIG. 1.

A tubular body 220 of the water discharge device of the present modification, as shown in FIG. 7, has a substantially bottle-like shape including a small diameter portion 21 and a large diameter portion 22 in the same manner as in the tubular body 20 shown in FIG. 1. The tubular body 220 on a large diameter portion 22 side is not opened. Therefore, in the present modification, the washing water which has flowed into the inflow chamber 203 can be guided into the tubular body 220 via through holes 23 to flow out of the tip of the small diameter portion 21.

In the lower part of the inflow chamber 203 (the upper part of a sealing member 156), a blade 263 is rotatably disposed at a position which is eccentric from a central axis C2 of the inflow chamber 203, and the blade 263 is directly rotated and driven by the flow of the water which has flowed into the inflow chamber 203 through the inflow hole 205. The blade 263 is provided with a gear 264 which is rotatable around the central axis of the eccentrically positioned blade 263 via a shaft 263*a*. The gear 264 is driven synchronously with the rotation driving of the blade 263.

A transmission disc 225 provided with gear teeth 265 is disposed rotatably around the central axis C2 by engagement of the gear teeth 265 with the gear 264. Furthermore, the transmission disc 225 is provided with a support portion 235 positioned eccentrically from the central axis C2, and is rotatably engaged with a transmission shaft 215 disposed at the lower end of the large diameter portion 22 of the tubular body 220. Furthermore, the transmission disc 225 is driven, when the blade 263 receives the flow of the washing water which has entered the inflow chamber 203 through the inflow hole 205.

When the blade 263 rotates in this manner, the rotation around the central axis C2 is transmitted to the tubular body 220 eccentrically from the central axis C2 of the inflow chamber 203. In this case, since the tubular body 220 tilts at a predetermined tilt angle from the central axis C2 as described above, the tubular body revolves in a swinging manner at this predetermined tilt angle. Moreover, when such swinging revolution occurs, the tubular body 220 receives a large drive force to rotate around a central axis C1 of the tubular body 220 itself by a frictional force generated in a contact portion of the tubular body 220 and the guide member 201.

Therefore, the water discharge device of the present modification can allow the tubular body 220 to rotate around the central axis C1 of the tubular body 220 itself while swinging and revolving around the central axis C2, whereby the water can flow out of the tip of the small diameter portion 21. It is to be noted that another structure is similar to that of the water discharge device described above with reference to FIG. 1 to FIG. 4.

Even in a case where as in the water discharge device of the present modification, not the swirling flow but the drive force of the blade 263 directly receiving the flow of the water which has entered the inflow chamber 203 through the inflow hole 205 is transmitted via the gear 264 to cause the swinging revolution and the rotation of the tubular body 220, as described above with reference to FIG. 5 and FIG. 6, the shower flow formed by the swinging revolution can cover an inner region which cannot be covered only by the shower flow formed by the rotation. Therefore, the shower flow does not have a so-called void portion, and an even planar shower flow can be obtained. Moreover, a plurality of water discharge holes 45 tilt in an asymmetric relation with respect to the central axis C1, and hence an effect similar to that described above with reference to FIG. 5 and FIG. 6 can be obtained.

Furthermore, when the water flows into the revolving tubular body 220 in the inflow chamber 203, the water has a swirling component. Therefore, the water can temporarily be received in the buffer chamber 43 to noticeably lower the flow speed of the water and lose the swirling component. Moreover, when the water passing through the water discharge holes 45 loses the swirling component, the water can securely be discharged in the tilt direction of the water discharge holes 45, and the scattering of the shower flow can be suppressed to obtain a shower flow having an even in-plane distribution and providing a sense of unity.

It is to be noted that the water discharge device of the present embodiment can be used not only as a shower device in a bathroom or a shower booth but also in, for example, a lavatory bowl provided with a washing function and the like.

DESCRIPTION OF REFERENCE NUMERALS

1: guide member
2: spherical portion
3: inflow chamber
3*a*: guide face
4: opening
5: inflow hole
6: sealing member
20: tubular body
21: small diameter portion
22: large diameter portion
23: through hole
24: opening
25: opening
40: head
41: buffer member
42: thin tube portion
43: buffer chamber
44: water sprinkling plate
45: water discharge hole
101: guide member
103: inflow chamber
103*a*: guide face
106: sealing member
108: path
109: inflow path
120: tubular body
122: axial flow blade
156: sealing member
201: guide member
203: inflow chamber
205: inflow hole
215: transmission shaft
220: tubular body
225: transmission disc
235: support portion
263: blade
263*a*: shaft
264: gear
265: gear teeth
FC: water discharge device

The invention claimed is:

1. A water discharge device which is configured to discharge water in a wide region while changing a water discharge direction, comprising:

a guide member including therein a formed inflow chamber into which the water flows and an opening which connects the inside of the inflow chamber to the outside of the inflow chamber;

a tubular body including a small diameter portion having a smaller diameter than the opening and a large diameter portion having a larger diameter than the opening, the small diameter portion having a tip thereof projected to the outside of the guide member through the opening, at least the large diameter portion being disposed in the inflow chamber, the tubular body being configured to allow the water which has flowed into the inflow chamber to flow out of the tip of the small diameter portion; and a water sprinkling member connected to the tip of the small diameter portion so that the water sprinkling member is positioned outside the guide member, provided with a plurality of water discharge ports and including therein a formed water storage chamber connected to the plurality of water discharge ports, respectively, wherein the tubular body is configured to swing and revolve around the central axis of the inflow chamber while tilting from the central axis of the inflow chamber in a state where at least a part of the small diameter portion comes in contact with the opening by the water which has flowed into the inflow chamber, and is configured to rotate around the central axis of the tubular body itself, and the center of gravity of a rotor constituted of the tubular body and the water sprinkling member is positioned near the opening which is located near the center of swing at which the central axis of the tubular body tilted by the swinging revolution and the central axis of the inflow chamber intersect in a state where any water is not supplied to the water storage chamber of the water sprinkling member, whereas the center of gravity of the rotor is moved to a water sprinkling member side in a state where the water is supplied to the water storage chamber of the water sprinkling member.

2. The water discharge device according to claim 1, wherein the center of gravity of the rotor in the state where any water is not supplied to the water storage chamber is positioned on the water sprinkling member side from the opening.

3. The water discharge device according to claim 1, wherein the water sprinkling member is provided with drain ports through which the water in the water storage chamber is discharged in a state where the water supply to the water storage chamber is stopped.

4. The water discharge device according to claim 3, wherein the water discharge ports are formed to perform a function of the drain ports, and the plurality of water discharge ports are formed with a predetermined distance therebetween near the peripheral edge of the water sprinkling member.

5. The water discharge device according to claim 1, wherein the guide member is provided with drain ports through which the water in the inflow chamber is discharged in a state where the water supply to the inflow chamber is stopped.

6. The water discharge device according to claim 5, wherein a space is formed between the opening and the tubular body, the water is supplied to the space so that the water performs a function of a bearing of the tubular body, and the space performs a function of the drain port.

7. The water discharge device according to claim 1, wherein the rotor constituted of the tubular body and the water sprinkling member is divided into at least two portions positioned near the opening, and the rotor is integrally formed of the divided portions.

8. The water discharge device according to claim 1, wherein the outer periphery of the water sprinkling member is formed so that the diameter of the outer periphery becomes larger than that of the large diameter portion of the tubular body.

* * * * *